United States Patent [19]

Umezaki et al.

[11] Patent Number: 5,003,959

[45] **Date of Patent: * Apr. 2, 1991**

[54] IGNITION COIL UNIT FOR AN INTERNAL COMBUSTION ENGINE

[75] Inventors: Tomokazu Umezaki; Tadao Takaishi, both of Himeji, Japan

[73] Assignee: Mitsubishi Denki Kabushiki Kaisha, Tokyo, Japan

[ * ] Notice: The portion of the term of this patent subsequent to Aug. 28, 2007 has been disclaimed.

[21] Appl. No.: 418,077

[22] Filed: Oct. 6, 1989

[30] Foreign Application Priority Data

Oct. 7, 1988 [JP] Japan ..... 63-252033
Oct. 13, 1988 [JP] Japan ..... 63-255831

[51] Int. Cl.[5] ..... F02P 3/04; H01F 31/00
[52] U.S. Cl. ..... 123/647; 123/634
[58] Field of Search ..... 123/634, 635, 647

[56] References Cited

U.S. PATENT DOCUMENTS

| | | | |
|---|---|---|---|
| 3,902,471 | 9/1975 | Brungsberg | 123/647 |
| 4,195,611 | 4/1980 | Wörz et al. | 123/635 |
| 4,198,943 | 4/1980 | Wörz | 123/635 |
| 4,224,917 | 9/1980 | Nakazawa et al. | 123/647 |
| 4,248,201 | 2/1981 | Tsutsui et al. | 123/634 |
| 4,392,473 | 7/1983 | Tsutsui et al. | 123/647 |
| 4,928,660 | 5/1990 | Söhner et al. | 123/647 |
| 4,951,641 | 8/1990 | Takaishi et al. | 123/634 |

FOREIGN PATENT DOCUMENTS

| | | | |
|---|---|---|---|
| 0004939 | 1/1977 | Japan | 123/634 |
| 0202376 | 11/1983 | Japan | 123/635 |

*Primary Examiner*—Tony M. Argenbright
*Assistant Examiner*—Robert E. Mates
*Attorney, Agent, or Firm*—Sughrue, Mion, Zinn, Macpeak and Seas

[57] ABSTRACT

An ignition coil unit for an internal combustion engine comprising a magnetic iron core, a primary coil wound around the iron core, a secondary coil electromagnetically coupled with the primary coil, a control circuit for controlling a primary electric current, and a case containing the iron core, the primary coil, the secondary coil and the control circuit therein. The ignition coil unit may further comprise a heat sink attached to the iron core, and the mold case may contain and integrally support the iron core and the heat sink, with at least part of the heat sink exposed to exterior of the mold case. The mold case defines a cavity containing therein the primary coil and the secondary coil wound around the iron core, and the space around the primary and second coils within the cavity is filled by a resin material.

7 Claims, 3 Drawing Sheets

IGNITION COIL UNIT FOR AN INTERNAL COMBUSTION ENGINE

BACKGROUND OF THE INVENTION

This invention relates to an ignition coil unit for an internal combustion engine.

FIG. 1 is a circuit diagram illustrating the conventional ignition coil unit for an internal combustion engine which comprises an ignition coil 1 and an ignitor 2. The ignition coil 1 and the ignitor 2 are enclosed within separate cases, and the case for the ignitor 2 is secured to a different place from the ignition coil 1 or attached to the case for the ignition coil 1 or housed within the interior of a distributor (not shown).

In the conventional ignition coil unit for an internal combustion engine as above constructed, the cases for the ignition coil and the ignitor are independent separate members, so that the ignition coil unit is large in overall dimension, needs a large installation space and is high in manufacturing cost.

SUMMARY OF THE INVENTION

Accordingly, one object of the present invention is to provide an ignition coil unit for an internal combustion engine free from the above-discussed problems of the conventional ignition coil unit.

Another object of the present invention is to provide an ignition coil unit for an internal combustion engine which can be easily installed in a small space.

Another object of the present invention is to provide an ignition coil unit for an internal combustion engine which is inexpensive.

Still another object of the present invention is to provide an ignition coil unit for an internal combustion engine which is easy in installation and inexpensive.

With the above objects in view, the ignition coil unit for an internal combustion engine of the present invention comprises a magnetic iron core, a primary coil wound around the iron core, a secondary coil electromagnetically coupled with the primary coil, a control circuit for controlling a primary electric current, and a single case containing the iron core, the primary coil, the secondary coil and the control circuit therein. According to the present invention, the control circuit, which is enclosed in a separate casing and attached as a separate part in the conventional design, is contained in the single case together with the ignition coil arrangement.

The ignition coil unit of the present invention may further comprise a heat sink attached to the iron core, and the mold case may contain and integrally support the iron core and the heat sink, with at least part of the heat sink exposed to the exterior of the mold case. The mold case defines a cavity containing the primary coil and the secondary coil wound around the iron core, and the space around the primary and second coils within the cavity defined in the mold case is filled by a resin filler material.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 2:
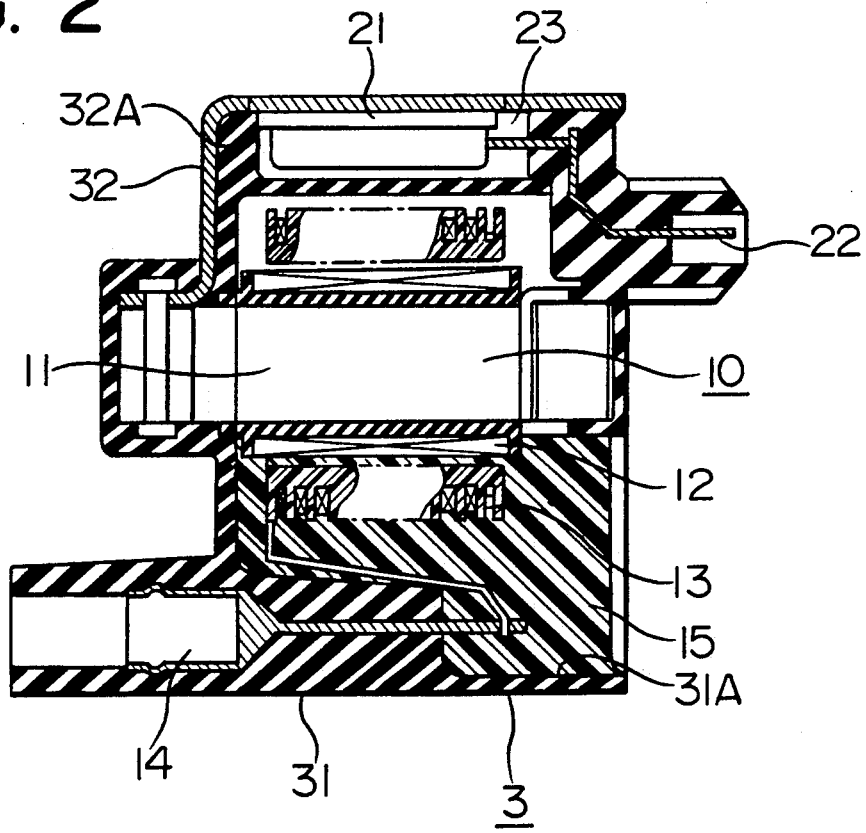
FIG. 2 is a sectional side view illustrating the ignition coil unit for an internal combustion engine of the present invention, taken along line II—II of FIG. 3.
Figure 3:
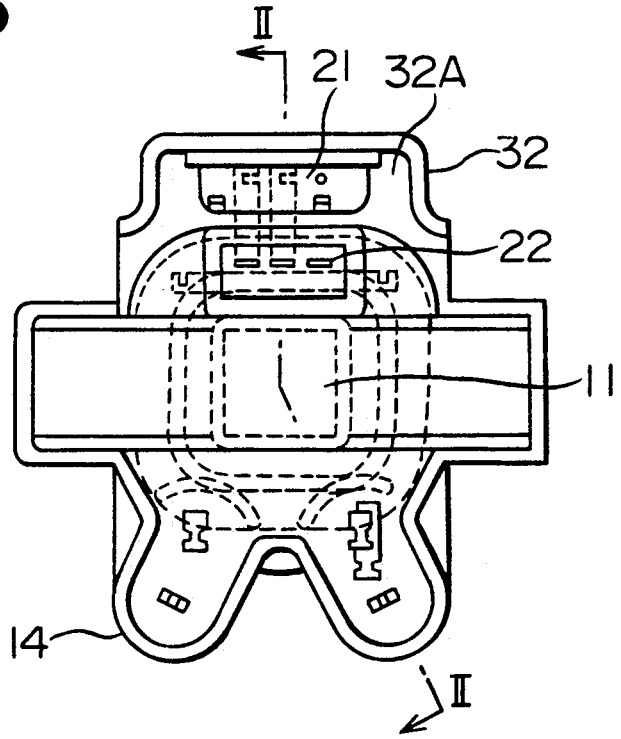
FIG. 3 is a front view of the ignition coil unit shown in FIG. 2.

In FIGS. 2 and 3, the ignition coil unit for an internal combustion engine constructed in accordance with the present invention comprises an ignition coil assembly 10 including a magnetic iron core 11, a primary coil 12 wound around the iron core 11 and a secondary coil 13 also wound around the iron core 11 and electromagnetically coupled with the primary coil 12. At each end of turns of the secondary coil 13, a high-tension terminal 14 is provided. A control circuit 21 including a power transistor is also provided for controlling a primary electric current flowing though the primary coil 12. The ignition coil unit also comprises a single case 3 containing the iron core 11, the primary coil 12, the secondary coil 13 and the control circuit 21 therein.

The case 3 comprises a first part 31 made of a molded resin in which the high-tension terminals 14 are insert-molded and to which a lower half of the ignition coil assembly 10 is supported, and a second part 32 made of a metallic material such as aluminium, iron, copper or an alloy of these metals and defining a space 32A for containing therein the upper half of the ignition coil assembly 10. As seen from FIG. 2, the space 32A also contains therein the control circuit 21 including the power transistor (not shown) for controlling the primary current. In order to establish a good heat conduction between the control circuit 21 and particularly the power transistor (not shown) for a superior heat conduction to the second half of the case 3, the space around the control circuit 21 within the space 32A is filled with a silicon gel material 23 having a good electrical insulation and heat-resistivity. The first part 31 of the case 3 defines a cavity 31A within which the coils 12 and 13 are disposed. The remaining space of the cavity 31A not occupied by the ignition coil assembly 10 is filled with an epoxy resin 15 to support and seal the ignition coil assembly 10. An input and an output terminal 22 are provided in the second part 32 of the case 3.

Figure 1:
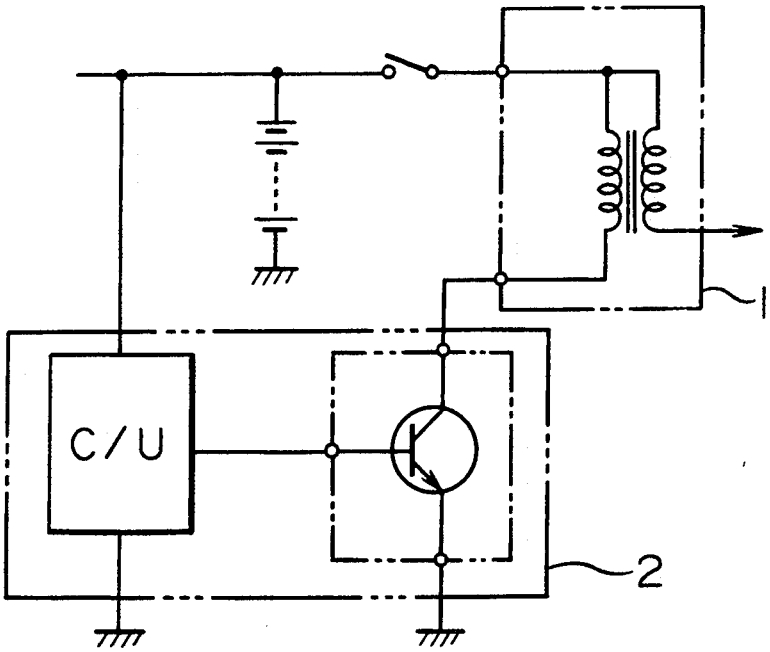
FIG. 1 is a circuit diagram illustrating the conventional ignition coil unit for an internal combustion engine.

In the arrangement as above described, the structure and the function of the control circuit 21 is substantially the same as those of the conventional control circuit 2 shown in FIG. 1 and the ignition coil assembly 10 is controlled by the power transistor of the control circuit 21.

As has been described, according to the present invention, since the control circuit 21 including the power transistor is contained within the single common case 3 together with the ignition coil assembly 10, the ignition coil unit can be made compact and light-weight and therefore the ignition coil unit is inexpensive and can be easily installed even in a narrow space.

Figure 4:
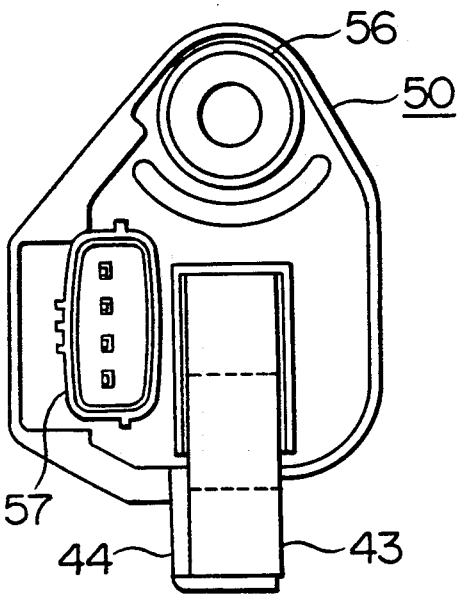
FIG. 4 is a front view illustrating another embodiment of the ignition coil unit for an internal combustion engine of the present invention.
Figure 6:
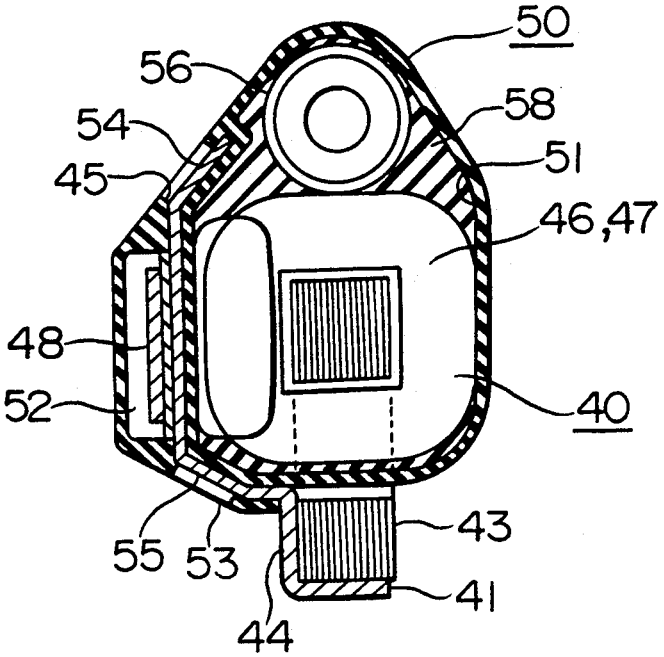
FIG. 6 is a sectional view taken along line VI—VI of FIG. 5.
Figure 5:
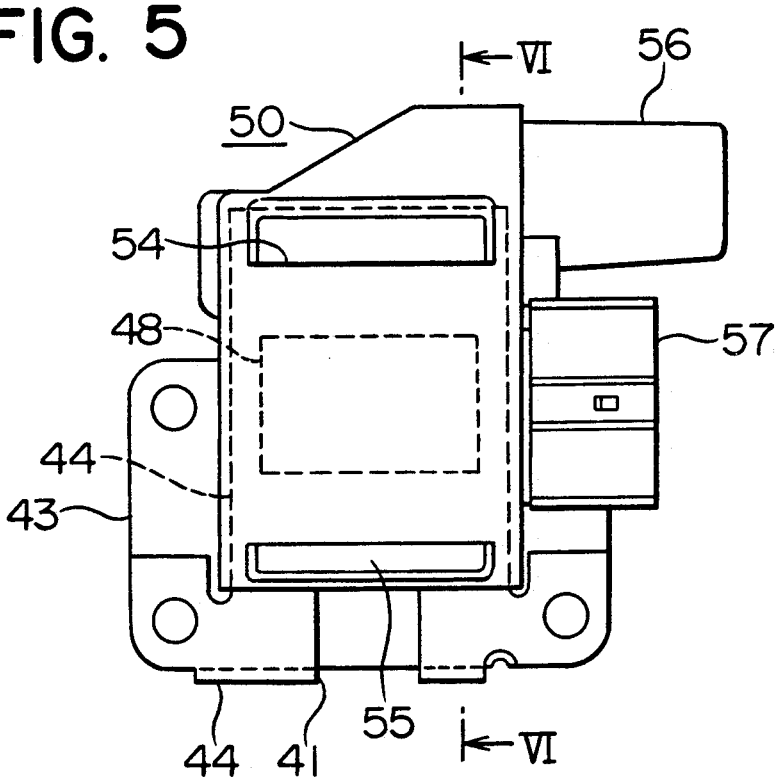
FIG. 5 is a side view of the ignition coil unit shown in FIG. 4.

FIGS. 4 to 6 illustrate another embodiment of the ignition coil unit for an internal combustion engine constructed in accordance with the present invention. The ignition coil unit of this embodiment comprises an ignition coil assembly 40 including a magnetic iron core 43, a primary coil 46 wound around the iron core 43 and a secondary coil 47 also wound around the iron core 43 and electromagnetically coupled with the primary coil 46. A heat sink 44 is securely attached to the iron core 43 at its attachment portion 41 fitted over the iron core 43. The ignition coil unit also comprises a control circuit 48 attached to the heat sink 44 for controlling the primary coil 46.

According to the present invention, the ignition coil unit further comprises a mold case 50 containing and integrally supporting therein the iron core 43 and the heat sink 44. The mold case 50 defines therein a cavity 51 containing therein the primary coil 46 and the secondary coil 47 wound around the iron core 43 and a pocket or a second cavity 52 containing therein the control circuit 48 including a power transistor (not shown) and constituting a part of an ignitor. The mold case 50 also has formed therein windows 45 and 53 for exposing some part of the surfaces 54 and 55 of the heat sink 44 to the exterior so that they serve as heat-dissipating surfaces. The mold case 50 further includes a high-tension output terminal 56 and a connector 57 for connecting the control circuit 48 to an external circuit (not shown).

The remaining space of the cavities 51 and 52 not occupied by the components such as the iron core 43, the coil assembly 46, 47 and the control circuit 48 is filled with a resin filler material 58 so that the space around the iron core 43 and, the primary and the secondary coils 46 and 47 within the cavity defined in the mold case 50 is sealed. The resin filler material 58 is an electrically insulating and heat-resisting material such as silicon gel and epoxy resins.

The heat generated from the control circuit 48 and particularly from the power transistor (not shown) during operation of the ignition coil unit is mainly conducted to the heat sink 44 and dissipated from the heat-dissipating surfaces 54 and 55 exposed through the windows 45 and 53 of the mold case 50. Also, the remaining heat generated by the control circuit 48 and the heat generated by the ignition coil assembly 40 are conducted to the mold case 50 through the resin filler material 58 and dissipated from the outer surfaces of the mold case 50.

As has been described, according to this embodiment of the present invention, the control circuit and the ignition coil assembly are contained in the single common mold case, so that the ignition coil unit can be made compact and light-weight. Also, since the heat sink is secured by fitting over the iron core and integrally fixed by the mold case, manufacture thereof is simple and the manufacturing cost can be decreased.

What is claimed is:

1. An ignition coil unit for an internal combustion engine comprising:

a magnetic iron core;

a primary coil wound around said iron core;

a secondary coil electromagnetically coupled with said primary coil;

a control circuit for controlling a primary electric current flowing through said primary coil;

a single common case containing said iron core, said primary coil, said secondary coil and said control circuit therein; and a heat sink (32; 44) secured to and supported by said iron core.

2. An ignition coil unit as claimed in claim 1, wherein said case defines a cavity for containing said iron core, said primary coil, said secondary coil and said control circuit, and said cavity is filled with a resin filler material.

3. An ignition coil unit as cliamed in claim 2, wherein said resin filler material is electrically insulating and heat-resisting.

4. An ignition coil unit as claimed in claim 1, wherein said case comprises a first part (31) made of a molded resin and a second part (32) made of a heat conductive material and constituting said heat sink.

5. An ignition coil unit as claimed in claim 4, wherein said control circuit is attached to said heat-conductive second part of said case.

6. An ignition coil unit as claimed in claim 1, wherein said heat sink is fitted over said iron core.

7. An ignition coil unit as claimed in claim 6, wherein said heat sink is partly insert molded within said case, and said case has formed therein a window through which said heat sink is exposed to provide a heat-dissipating surface.

* * * * *